United States Patent [19]

Morita

[11] 4,368,570

[45] Jan. 18, 1983

[54] METHOD OF AND APPARATUS FOR ATTACHING TOP AND BOTTOM STOPS TO A SLIDE FASTENER CHAIN

[75] Inventor: Toyoo Morita, Uozu, Japan

[73] Assignee: Yoshida Kogyo K. K., Tokyo, Japan

[21] Appl. No.: 322,886

[22] Filed: Nov. 19, 1981

[30] Foreign Application Priority Data

Nov. 27, 1980 [JP] Japan ..... 55-167266

[51] Int. Cl.[3] ..... B21D 53/56

[52] U.S. Cl. ..... 29/408; 29/409; 29/766; 29/767; 29/33.2

[58] Field of Search ..... 29/408, 409, 766, 767, 29/768, 33.2, 410, 770; 264/252, 23; 425/814

[56] References Cited

U.S. PATENT DOCUMENTS 4,110,890 9/1978 Akashi ..... 29/766
4,190,944 3/1980 Yoshida et al. ..... 29/33.2
4,217,685 8/1980 Seki ..... 29/408

FOREIGN PATENT DOCUMENTS 2035444 6/1980 United Kingdom ..... 29/408

*Primary Examiner*—Ervin M. Combs
*Assistant Examiner*—Steven E. Nichols
*Attorney, Agent, or Firm*—Hill, Van Santen, Steadman, Chiara & Simpson

[57] ABSTRACT

A method of attaching top and bottom stops to a slide fastener chain at one and the same stage of manufacture. The fastener chain is moved along a path until a trailing end of a preceding pair of coupling element groups arrives at a first fixed die, by which time leading end portions of a succeeding pair of coupling element groups are disengaged from each other. With the trailing end of the preceding pair of coupling element groups retained at the first die, an adjacent pair of opposed blank tape portions is sagged until the endmost disengaged coupling elements arrive at a second fixed die spaced a predetermined distance from the first die along the path. Finally, a bottom stop and a pair of top stops are attached concurrently and respectively to the trailing end of the preceding pair of coupling element groups at the first die and to the disengaged endmost portions of the succeeding pair of coupling element groups at the second die. An apparatus for carrying out this method is also disclosed.

10 Claims, 13 Drawing Figures

METHOD OF AND APPARATUS FOR ATTACHING TOP AND BOTTOM STOPS TO A SLIDE FASTENER CHAIN

BACKGROUND OF THE INVENTION

1. Field of the Invention

The present invention relates to the production of slide fasteners, and more particularly to a method of and an apparatus for attaching top and bottom end stops to a slide fastener chain.

2. Prior Art

In the slide fastener industry, it has hitherto been a common practice that top end stops and bottom end stops are attached to a slide fastener chain at totally separate stages of manufacture, thus producing slide fasteners with only a limited rate of production.

SUMMARY OF THE INVENTION

According to a first aspect of the invention, there is provided a method of attaching top and bottom end stops to a slide fastener chain including a pair of continuous stringers, each stringer having successive spaced groups of coupling elements mounted on a continuous stringer tape and interengaged with opposed complementary groups of coupling elements on the other stringer tape, the fastener chain having successive spaced pairs of opposed blank tape portions between the successive spaced pairs of coupling element groups, there being a plurality of sliders each threaded on a respective one of the successive spaced pairs of coupling element groups at a predetermined position, said method comprising the steps of: moving the fastener chain longitudinally along a path in a predetermined direction; sensing the arrival of one of the successive spaced pairs of coupling element groups; in response to said arrival, disengaging leading end portions of said one of the successive pairs coupling element groups; further moving the fastener chain along the path in said predetermined direction until a trailing end of a preceding pair of coupling element groups arrives at a first fixed point; with the trailing end of the preceding pair of coupling element groups retained at said first fixed point, sagging one of the successive pairs of opposed blank tape portions until the endmost disengaged coupling elements arrive at a second fixed point spaced a predetermined distance from said first fixed point along the path; and attaching a bottom end stop and a pair of top end stops concurrently and respectively to the trailing end of the preceding pair of coupling element groups at said first fixed point and the disengaged endmost portions of said one of the successive pairs of coupling element groups at said second fixed point.

According to a second aspect of the invention, there is provided an apparatus for attaching top and bottom end stops to a slide fastener chain including a pair of continuous stringers, each stringer having successive spaced groups of coupling elements mounted on a continuous stringer tape and interengaged with opposed complementary groups of coupling elements on the other stringer tape, the fastener chain having successive spaced pairs of opposed blank tape portions between the successive spaced pairs of coupling element groups, there being a plurality of sliders each threaded on a respective one of the successive spaced pairs of coupling element groups at a predetermined position, said apparatus comprising: a frame having a guide table for supporting thereon the fastener chain; means for moving the fastener chain longitudinally along a path over said guide table in a predetermined direction; means for sensing the arrival of one of the successive spaced pairs of coupling element groups; means responsive to said arrival for disengaging leading end portions of said one of the successive pairs of coupling element groups; a pair of first and second fixed dies spaced a predetermined distance from each other along the path; means for further moving the fastener chain along the path in said predetermined direction until a trailing end of a preceding pair of coupling groups arrives at said first die; means, responsive to said arrival of the trailing end of the preceding pair of coupling element groups, for sagging one of the successive pairs of opposed blank tape portions until the endmost disengaged coupling elements arrive at said second die, said further moving means being effective to retain the trailing end of the preceding pair of coupling element groups at said first die during said sagging; and a pair of first and second punches cooperative with said first and second dies, respectively, to attach a bottom end stop and a pair of top end stops concurrently and respectively to the trailing end of the preceding pair of coupling element groups at said first die, and to the disengaged endmost portions of said one of the successive pair of coupling element groups at said second die.

It is therefore an object of the invention to provide a method of attaching top and bottom end stops to a slide fastener chain at one end the same stage of manufacture, thus producing slide fasteners with an increased rate of production.

Another object of the invention is to provide an apparatus for carrying out the above-mentioned method, which apparatus has a relatively simple construction.

Still another object of the invention its to provide such method and apparatus which are applicable to various slide fastener chains each having successive spaced pairs of blank (element-free) tape portions of a different length.

Other objects and a fuller understanding of the invention may be had by referring to the following description and claims, taken in conjunction with the accompanying drawings in which:

DETAILED DESCRIPTION

Figure 1:
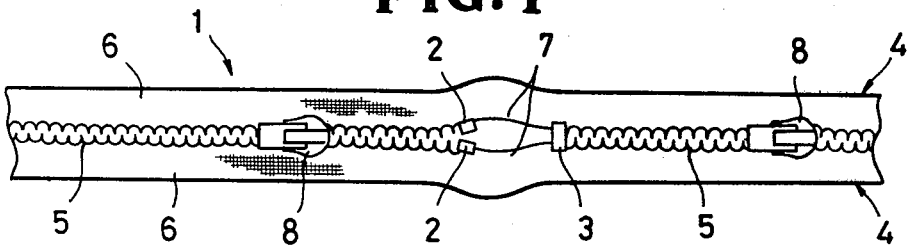
FIG. 1 is a fragmentary plan view of a slide fastener chain to which top and bottom end stops have been attached in accordance with the present invention.
Figure 2:
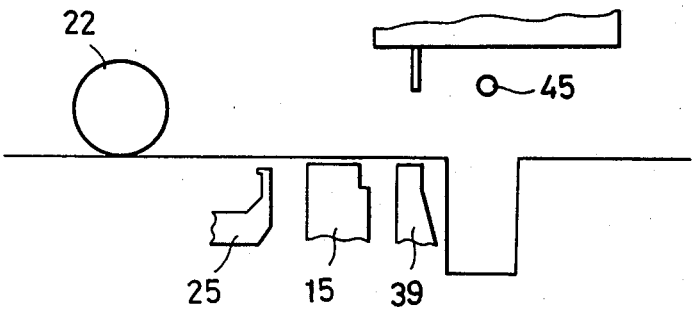
FIGS. 2 through 10 illustrate a sequence of steps of a method according to the invention.

FIG. 1 shows a slide fastener chain 1 to which top and bottom end stops 2,3 have been attached by the method and apparatus 10 (FIGS. 11 and 12) according to the present invention. The slide fastener chain 1 includes a pair of continuous stringers 4,4. Each stringer 4 has successive spaced groups of coupling elements 5 mounted on a continuous stringer tape 6 along an inner longitudinal edge thereof and interengaged with opposed complementary groups of coupling elements 5 on the other stringer tape 6, there being successive spaced pairs of opposed blank tape portions 7,7 between the successive spaced pairs of coupling element groups 5,5. A plurality of sliders 8 is threaded one on each of the successive pairs of coupling element groups 5,5 at a predetermined position.

Figure 10:
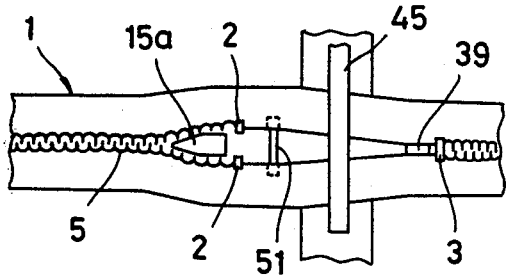
Figure 11:
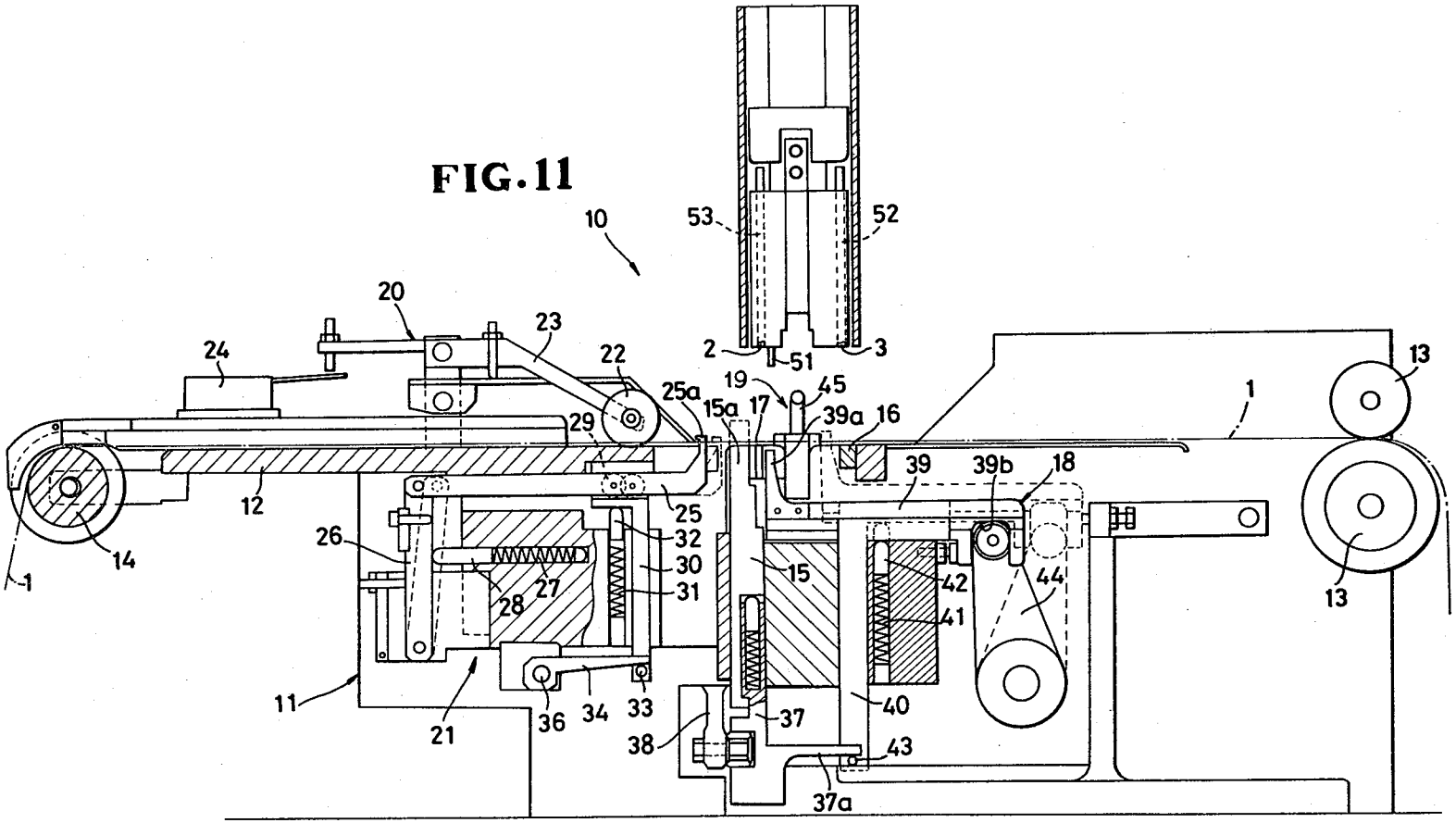
FIG. 11 is a side elevational view, with parts broken away, of an apparatus for carrying out the method.
Figure 12:
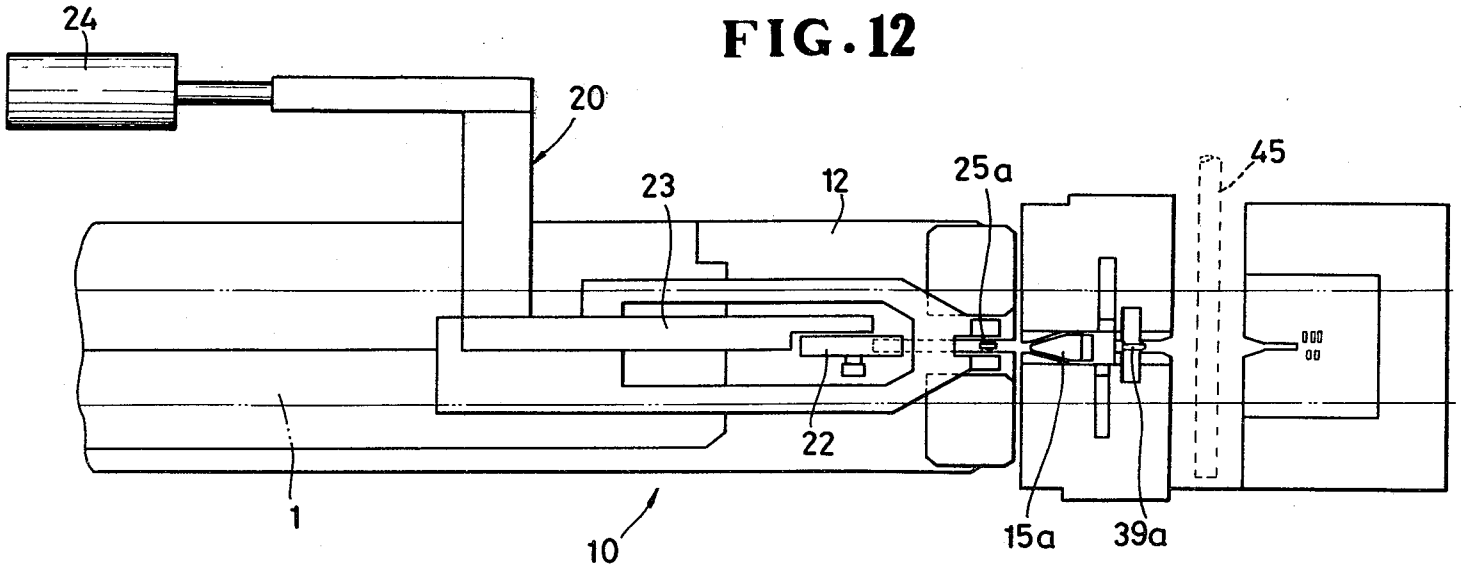
FIG. 12 is a top plan view, with parts omitted, of the apparatus.

As shown in FIGS. 11 and 12, the apparatus 10 generally comprises a frame 11 having a guide table 12 for supporting thereon the fastener chain 1 along a horizontal path, a pair of feed rollers 13,13 and a guide roller 14 disposed downstream and upstream, respectively, of the guide table 12 for moving or feeding the fastener chain 1 longitudinally along the path over the guide table 12 in a predetermined direction, rightwardly in FIGS. 11 and 12, a sensing mechanism (described below) for sensing the arrival of one of the successive pairs of coupling element groups 5,5 and for terminating the movement of the fastener chain 1, a separator 15 for separating or disengaging leading end portions **5*a*,5*a* (FIGS. 5, 6, 8 and 10) of an adjacent pair of interengaged coupling element groups 5,5, a pair of first and second fixed dies 16,17 disposed downstream of the separator 15 and spaced a predetermined distance from each other along the path, a first positioning unit 18 for further moving the fastener chain 1 along the path in the predetermined direction until a trailing end 5*b* (FIGS. 4, 6, and 8) of a preceding pair of coupling element groups 5,5 arrives at the first die 16, a second positioning unit 19 (FIG. 13) for sagging an adjacent pair of opposed blank tape portions 7,7 until the disengaged endmost portions (5*a*,5*a*) of one of the successive pairs of coupling element groups 5,5 arrive at the second die 17, and a pair of first and second punches 52,53 cooperative with the first and second dies 16,17, respectively, to attach a bottom stop 3 and a pair of top end stops 2,2 concurrently and respectively to the trailing end 5*b* of the preceding pair of coupling element groups 5,5 at the first die 16 and to the disengaged endmost portions (5*a*,5*a*) of one of the successive pairs of coupling element groups 5,5 at the second die 17**.

The sensing mechanism comprises a detecting unit 20 for detecting the arrival of one of the sliders 8 that is on a preceding pair of coupling element groups 5,5, and a terminating unit 21 for terminating the movement of the fastener chain 1 when a predetermined amount of movement has occurred after the detection. The detecting unit 20 includes a feeler roll 22 disposed at a fixed point on the path for engagement with the sliders 8 one at each time a respective one of the successive pairs of coupling element groups 5,5 arrives, and an actuating member 23 pivotally supported by the frame 11 and connected at one end to the feeler roll 22. The actuating member 23 is pivotable with respect to the guide table 12, in response to the engagement of the feeler roll 22 with the slider 8, to actuate by its other end a switch 24 which produces a signal for initiating the operation of the terminating unit 21, as described below.

The terminating unit 21 includes a stop member 25 horizontally extending beneath the path and having an upwardly angled tip end **25*a*. At the other end remote from the angled tip end 25*a*, the stop member 25 is pivotally connected to a free end of a vertical lever 26 which is pivotally mounted on the frame 11 and which is normally urged leftwardly, i.e. in a direction opposite to the predetermined direction of movement of the fastener chain 1, by means of a spring 27 and a pusher 28. A roll 29 is mounted on the stop member 25 and rests on the top of a vertical support 30 which is vertically movable between its raised position in which the tip end 25*a* of the stop member 25 is inserted into a space between the opposed blank tape portions 7,7 of an adjacent pair, and its lowered position in which the tip end 25*a* of the stop member 25 is retracted out of the path. Thus the stop member 25 is horizontally movable, in response to the pivotal movement of the vertical lever 26, along the path between a first position where the tip end 25*a* of the stop member 25 is inserted into a space between the opposed blank tape portions 7,7 of an adjacent pair and a second position where the movement of the fastener chain 1 is halted and the tip end 25*a* of the stop member 25 is retracted out of the path. The vertical support 30 is normally urged toward its raised position by means of a spring 31 and a pusher 32. Mounted on the vertical support 30 at its lower end is a pin 33 to which an actuating lever 34 is operatively connected. When the actuating lever 34 is pivoted about a shaft 36 clockwise or downwardly in FIG. 11, the vertical support 30 is moved to its lowered position against the bias of the spring 31. Counterclockwise or upward pivotal movement of the actuating lever 34 will allow the vertical support 30 to be moved to its raised position under the biasing force of the spring 31**.

Figure 7:
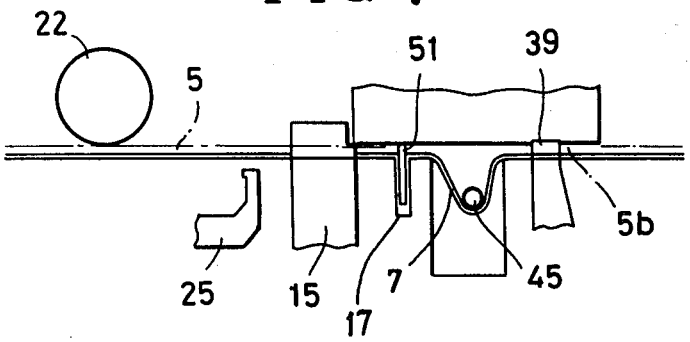
Figure 8:
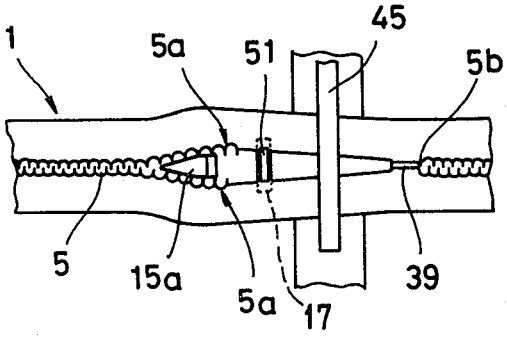
Figure 9:
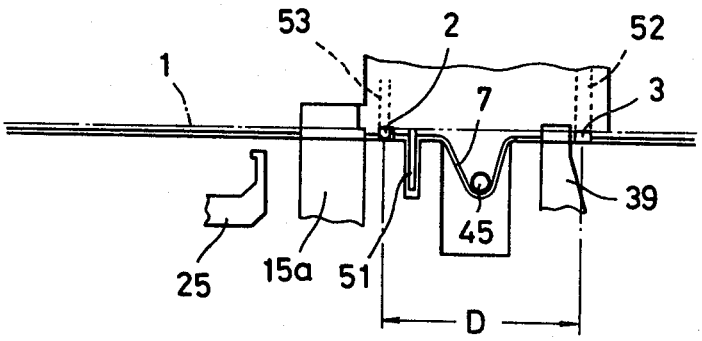

The separator 15 is disposed downstream of the stop member 25 and has a tip end **15*a* of wedge-shaped cross section (FIGS. 8,9 and 12). The separator 15 is connected to an actuating member 37 which is vertically moved by means of a power transmitting lever 38. Substantially concurrently with the retraction of the stop member 25, the separator 15 is raised to project at its wedge-shaped end portion 15*a* into a space between the opposed blank tape portions 7,7 of an adjacent pair so that the leading end portions 5*a*,5*a* of one of the successive pairs of coupling element groups 5,5 are disengaged or split from each other as they pass the wedge-shaped end portion 15*a* of the separator 15. The wedge-shaped end portion 15*a* of the separator 15 further serves to guide the disengaged endmost coupling elements (5*a*,5*a*) to the second die 17 for attachment of a pair top end stops 2,2 as shown in FIG. 10. Designated at 31 (FIGS. 7–11**) is an auxiliary guide plate for facilitating such guiding.

The first positioning unit 18 is disposed downstream of the separator 15 and includes a pull member 39 horizontally extending beneath the path and having an upwardly angled tip end **39*a*. The pull member 39 is horizontally movably supported by a vertical support 40 which is vertically movable between a raised position in which the tip end 39*a* of the pull member 39 is inserted into a space between the opposed blank tape portions 7,7 of an adjacent pair, and a lowered position in which the tip end 39*a* of the pull member 39 is retracted out of the path. The vertical support 40 is normally urged toward its raised position by means of a spring 41 and a pusher 42. Mounted on the vertical support 40 at its lower end is a pin 43 to which a horizontal arm 37*a* of the actuating member 37 is operatively connected. Accordingly, concurrently with the raising of the separator 15, the pull member 39** is moved to its raised position.

At the other end remote from the angled tip end **39*a*, the pull member 39 has a downwardly opening recess 39*b* in which a free end of a power transmitting lever 44 is received. As the power transmitting lever 44 is pivoted clockwise in FIG. 11 through a predetermined angle, the pull member 39, with the tip end 39*a* in engagement with the trailing end 5*b* of a preceding pair of coupling element groups 5,5, is moved along the path to pull the fastener chain 1 until the trailing end 5b of the preceding pair of coupling element groups 5,5 arrives at the first die 16 for attachment of a bottom end stop 3**, as described below.

Figure 13:
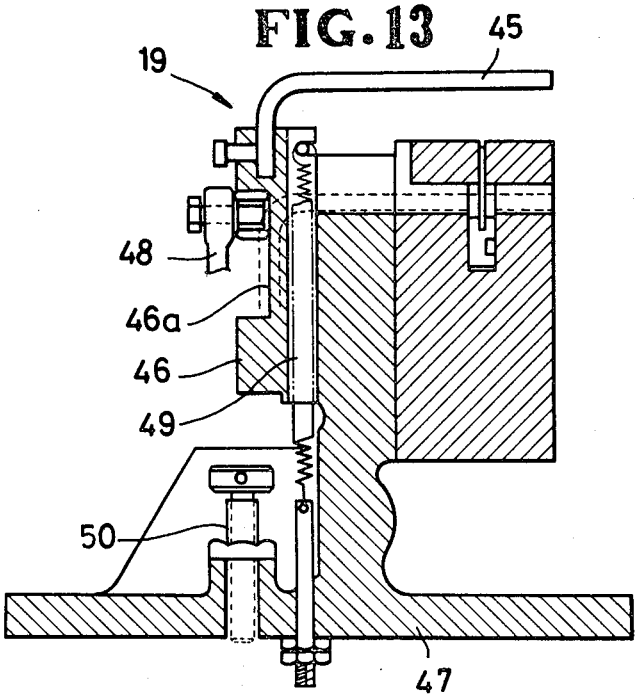
FIG. 13 is an enlarged cross-sectional view of a blank-tape-portion sagging unit of the apparatus.

The second positioning unit 19 is disposed between the first and second dies 16,17, which are spaced a predetermined distance D (FIG. 9) from each other along the path. As best shown in FIG. 13, the second positioning unit 19 includes a push bar 45 extending transversely of the path and movable vertically, i.e. perpendicularly to the general plane of the guide table 12, beyond the path between its raised position (solid lines in FIG. 13) in which the push bar 45 is disposed above the path and its lowered position (phantom lines in FIG. 13) in which the push bar 45 is disposed beneath the path, thereby pushing the opposed blank tape portions 7,7 of an adjacent pair downwardly away from the path. The push bar 45 is supported only at one end by a vertical support 46 which is vertically movably mounted on a base 47. The vertical support 46 has a recess 46a in which a free end of a power transmitting lever 48 is received. The vertical support 46 is normally urged downwardly by means of a spring 49. As the power transmitting lever 48 is pivoted about a shaft (not shown) downwardly from the position of FIG. 13, the push bar 45 is moved from its raised position to its lowered position under the biasing force of the spring 49. Designated at 50 is an adjusting bolt disposed beneath the vertical support 46 for adjustably limiting the downward movement of the support 46, thus adjustably defining the stroke of the push bar 45.

Figure 3:
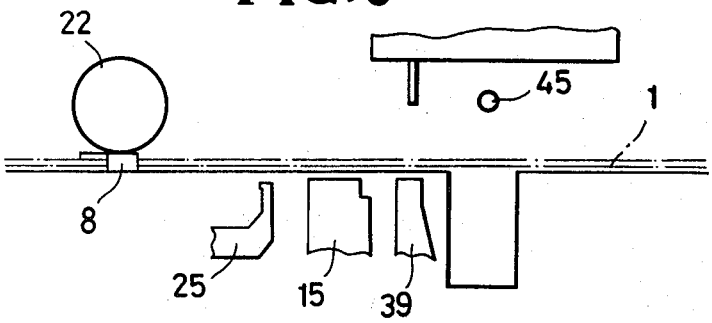

In operation, a slide fastener chain 1 (FIG. 1) is moved forwardly or rightwardly along the path through the apparatus 10 (FIG. 11) via the guide roller 14 by the feed rollers 13,13. When one of the rollers 8 that is on a preceding pair of coupling element groups 5,5 comes into engagement with the feeler roll 22 of the detecting unit 20 (FIG. 3), the actuating member 23 is pivotally moved to actuate the switch 24 for initiating the operation of the terminating unit 21, as described below.

Figure 4:
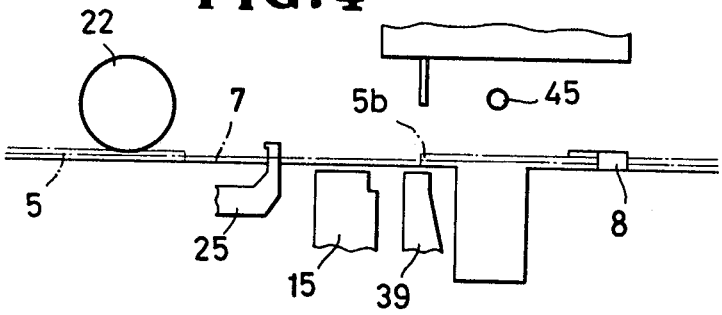

In response to actuation of the switch 24, the actuating lever 34 of the terminating unit 21 is pivotally moved about the shaft 36 in a counter-clockwise direction to allow the vertical support 30 to be moved to its raised position under the biasing force of the spring 31, raising the stop member 25. The tip end 25a of the stop member 25 is thus inserted into a space between the opposed blank tape portions 7,7 of an adjacent pair (FIG. 4). The leading end 5a,5a of one of the successive pairs of coupling element groups 5,5 then comes into engagement with the tip end 25a of the stop member 25. With the tip end 25a in engagement with the leading end (5a,5a) of one of the successive pairs of coupling element groups 5,5, the stop member 25 is moved from a first position (solid lines in FIG. 11) to a second position (phantom lines in FIG. 11), causing the vertical lever 26 to be pivotally moved clockwise to deenergize the feed rollers 13,13. The movement of the fastener chain 1 is thus halted and, at the same time, the stop member 25 is lowered to retract the tip end 25a out of the path (FIG. 5).

Figure 5:
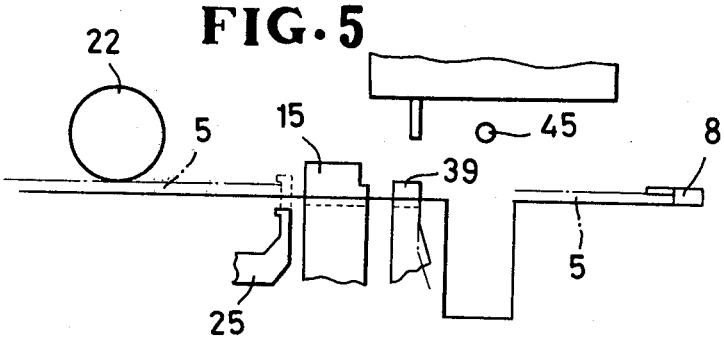

Substantially concurrently with the retraction of the stop member 25, the power transmitting lever 38 is pivotally moved so as to raise the actuating member 37, thus bringing the separator 15 and the pull member 39 upwardly to the raised position in which their respective tip ends 15a and 39a are inserted into the space between the opposed blank tape portions 7,7 of an adjacent pair (FIG. 5).

Figure 6:
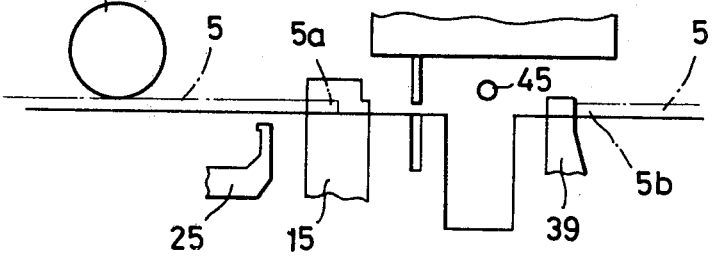

Then, the pull member 39, with the tip end 39a in engagement with the trailing end 5b of the preceding pair of coupling element groups 5,5, is moved along the path from the position of FIG. 5 to the position of FIG. 6 to pull the fastener chain 1 unitl the trailine end 5b of the preceding pair of coupling element groups 5,5 arrives at the first die 16. During that time the leading end portions 5a,5b of the successive pair of coupling element groups 5,5 are disengaged or split from each other as they pass the wedge-shaped end portion 15a of the separator 15 (FIG. 6).

In response to the arrival of the trailing end 5b of the preceding pair of coupling element groups 5,5 at the first die 16, the power transmitting lever 48 is pivotally moved so as to lower the push bar 45 from the position of FIG. 6 to the position of FIG. 7, thereby pushing the opposed blank tape portions 7,7 of an adjacent pair downwardly away from the path until the disengaged endmost portions (5a,5a of one of the successive pairs of coupling element groups 5,5 arrive at the second die 17 (FIGS. 7 and 8). During that time the trailing end 5b of the preceding pair of coupling element groups 5,5 is retained at the first die 16.

Finally, the first and second punches 52,53 are lowered at the same time to attach a bottom end stop 3 and a pair of top end stops 2,2 concurrently and respectively to the trailing end 5b of the preceding pair of coupling element groups 5,5 at the first die 16 and to the disengaged endmost portions (5a,5a) of one of the successive pairs of coupling element groups 5,5 at the second die 17.

If the length of a single pair of opposed blank tape portions 7,7 of the fastener chain 1 used is equal to the spacing D (FIG. 9) between the first and second dies 16,17, the disengaged endmost portions (5a,5a) of one of the successive pairs of coupling element groups 5,5 will arrive at the second die 17 at the same time as the trailing end 5b of the preceding pair of coupling element groups 5,5 arrives at the first die 16. Therefore, in that event, the sagging step may be omitted.

It will be understood that various change in the details, material, and arrangements of parts, which have been herein described and illustrated in order to explain the nature of the invention, may be made by those skilled in the art within the principle and scope of the invention as recited in the appended claims.

What is claimed is:

1. A method of attaching top and bottom end stops to a slide fastener chain including a pair of continuous stringers, each stringer having successive spaced groups of coupling elements mounted on a continuous stringer tape and interengaged with opposed complementary groups of coupling elements on the other stringer tape, the fastener chain having successive spaced pairs of opposed blank tape portions between the successive spaced pairs of coupling elements groups, there being a plurality of sliders each threaded on a respective one of the successive spaced pairs of coupling element groups at a predetermined position, said method comprising the steps of:

(a) moving the fastener chain longitudinally along a path in a predetermined direction;

(b) sensing the arrival of one of the successive spaced pairs of coupling element groups;

(c) in response to said arrival, disengaging leading end portions of said one of the successive pairs coupling element groups;

(d) further moving the fastener chain along the path in said predetermined direction until a trailing end of a preceding pair of coupling element groups arrives at a first fixed point;

(e) with the trailing end of the preceding pair of coupling element groups retained at said first fixed point, sagging one of the successive pairs of opposed blank tape portions until the endmost disengaged coupling elements arrive at a second fixed point spaced a predetermined distance from said first fixed point along the path; and (f) attaching a bottom end stop and a pair of top end stops concurrently and respectively to the trailing end of the preceding pair of coupling element groups at said first fixed point and to the disengaged endmost portions of said one of the successive pairs of coupling element groups at said second fixed point.

2. A method according to claim 1, said sensing being effected by detecting the arrival of one of the sliders that is on the preceding pair of coupling element groups.

3. A method according to claim 1, including the further step of terminating the movement of the fastener chain when a predetermined amount of travel has occurred after said arrival.

4. An apparatus for attaching top and bottom end stops to a slide fastener chain including a pair of continuous stringers, each stringer having successive spaced groups of coupling elements mounted on a continuous stringer tape and interengaged with opposed complementary groups of coupling elements on the other stringer tape, the fastener chain having successive spaced pairs of opposed blank tape portions between the successive spaced pairs of coupling element groups, there being a plurality of sliders each threaded on a respective one of the successive spaced pairs of coupling element groups at a predetermined position, said apparatus comprising:

(a) a frame having a guide table for supporting thereon the fastener chain;

(b) means for moving the fastener chain longitudinally along a path over said guide table in a predetermined direction;

(c) means for sensing the arrival of one of the successive spaced pairs of coupling element groups;

(d) means responsive to said arrival for disengaging leading end portions of said one of the successive pairs of coupling element groups;

(e) a pair of first and second fixed dies spaced a predetermined distance from each other along the path;

(f) means for further moving the fastener chain along the path in said predetermined direction until a trailing end of a preceding pair of coupling groups arrives at said first die;

(g) means, responsive to said arrival of the trailing end of the preceding pair of coupling element groups, for sagging one of the successive pairs of opposed blank tape portions until the endmost disengaged coupling elements arrive at said second die, said further moving means retaining the trailing end of the preceding pair of coupling element groups at said first die during said sagging; and (h) a pair of first and second punches cooperative with said first and second dies, respectively, for attaching a bottom end stop and a pair of top end stops concurrently and respectively to the trailing end of the preceding pair of coupling element groups at said first die and to the disengaged endmost portions of said one of the successive pairs of coupling element groups at said second die.

5. An apparatus according to claim 4, said sensing means including means for detecting the arrival of one of the sliders that is on one the successive pairs of coupling element groups, and means for terminating the movement of the fastener chain when a predetermined amount of movement has occurred after the arrival of said one of the successive pairs of coupling element groups.

6. An apparatus according to claim 5, said detecting means comprising a feeler roll disposed at a fixed point on the path for engagement with the sliders once each time a respective one of the successive pairs of coupling element groups arrives, and an actuating member connected to said feeler roll and pivotable on said frame, in response to the engagement of said feeler roll with the slider, to actuate a switch for initiating the operation of said movement terminating means.

7. An apparatus according to claim 5, said terminating means comprising a stop member disposed beneath the path and having a tip end insertable into a space between the opposed blank tape portions of an adjacent pair, in response to said detection, to engage with the leading end of said one of the successive pairs of coupling element groups, said stop member, with said tip end in engagement with the leading end of said one pair of coupling element groups, being movable along the path from a first position where said tip end is inserted into a space between the opposed blank tape portions of an adjacent pair to a second position where the movement of the fastener chain is halted and said tip end is retracted out of the path.

8. An apparatus according to claim 4, said disengaging means comprising a separator having a tip end portion of wedge-shaped cross section, said separator being movable, in response to said arrival, to project at said tip end portion into a space between the opposed blank tape portions of an adjacent pair, thereby disengaging the leading end portions of said one of the successive pairs of coupling element groups as they pass said tip end portion of said separator.

9. An apparatus according to claim 4, said further moving means comprising a pull member disposed beneath the path and having a tip end insertable into a space between the opposed blank tape portions of an adjacent pair, in response to said arrival, to engage with the trailing end of the preceding pair of coupling element groups, said pull member, with said tip end in engagement with the trailing end of said preceding pair of coupling element groups, being movable along the path to pull the fastener chain until the trailing end of the preceding pair of coupling element groups arrives at said first die.

10. An apparatus according to claim 4, said sagging means comprising a push bar extending transversely of the path and movable, in response to said arrival of the trailing end of the preceding pair of coupling element groups at said first die, perpendicularly to the general plane of said guide table beyond the path to push said one of the successive pairs of opposed blank tape portions away from the path until the disengaged endmost portions of said one of the successive pairs of coupling element groups arrive at said second die.

* * * * *